United States Patent [19]

Haugsjaa et al.

[11] 3,943,402

[45] Mar. 9, 1976

[54] TERMINATION FIXTURE FOR AN ELECTRODELESS LAMP

[75] Inventors: Paul Osborne Haugsjaa, Acton; William Henry McNeill, Carlisle; Robert James Regan, Needham; Joseph Martin Lech, Westford, all of Mass.

[73] Assignee: GTE Laboratories Incorporated, Waltham, Mass.

[22] Filed: Apr. 21, 1975

[21] Appl. No.: 570,055

[52] U.S. Cl. ..... 315/39; 315/248

[51] Int. Cl.[2] ..... H01J 61/56

[58] Field of Search ..... 315/39, 248, 344, 267; 313/182

[56] References Cited

UNITED STATES PATENTS 3,787,705 1/1974 Bolin et al. ..... 315/248

*Primary Examiner*—R. V. Rolinec

*Assistant Examiner*—Darwin R. Hostetter

*Attorney, Agent, or Firm*—Irving M. Kriegsman; Leslie J. Hart

[57] ABSTRACT

An improved termination fixture for an electrodeless light source matches the complex impedance of an electrodeless lamp during excitation to the output impedance of a high frequency power source coupled to the fixture. The inner conductor of the fixture has a first and a second section. The dimensions of the first section are such as to produce an input impedance whose reactive impedance part is much smaller than the reactive impedance part of the lamp impedance. The dimensions of the second section are such as to match the input impedance to the source output impedance.

10 Claims, 3 Drawing Figures

TERMINATION FIXTURE FOR AN ELECTRODELESS LAMP

BACKGROUND OF THE INVENTION

The present invention relates to electrodeless light source and, more particularly, to such sources which are excited by high frequency power, such as in the range of 100 MHz to 300 GHz.

There have been, historically, three basic methods of exciting discharges without electrodes. The first method uses the discharge as a lossy part of either the capacitance or inductance of a "tank" circuit. This method is used to advantage only at frequencies where the dimensions of the lamp are much smaller than the wavelength of excitation. Also, in this method, there are power losses due to radiation and shifts in frequency upon start-up. A second method of exciting electrodeless lamps with microwave power is to place the lamp in the path of radiation from a directional antenna. However, since free propagation of microwave power occurs, there is an inherent inefficiency and some of the power is scattered thereby endangering persons in the area.

A third method uses a resonant cavity which contains the lamp, a frequency tuning stub and a device for matching the lamp-cavity impedance to that of the source and transmission line. Examples of devices according to this method may be found in "Microwave Discharge Cavities Operating at 2450 MHz" by F. C. Fehsenfield et al., Review of Scientific Instruments, Volume 36, Number 3, (March, 1965). This publication describes several types of tunable cavities. In one type, cavity number 5, the discharge cavity transfers power from the source to the lamp, and the resonant structure of the cavity increases the electric field in the gas of the lamp. The presence of a discharge in the resonator changes the resonant frequency and also changes the loaded Q factor. Therefore, it is necessary to provide both tuning (frequency) and matching (impedance) adjustments to obtain effiecient operation over a wide range of discharge conditions. The tuning stub is first adjusted for a minimum reflected power with the minimum probe penetration. Next, the probe (impedance) is adjusted. Since these two operations are not independent, successive readjustments are required to achieve optimum efficiency.

All of these tunable cavities have features which make them less than ideally suited for use in an electrodeless light source. To make cavity type systems useful ecomonically, the cavity must be small enough so that it would be feasible to use such systems in place of the conventional electrode-containing lamp. Resonant cavities are too large and must be larger if lower microwave frequencies are used. One resonant cavity for 2450 MHz operation has 4 inches as its greatest dimension; the size would be even larger for operation at 915 MHz which is a standard microwave frequency for comsumer use, such as with microwave ovens. Operation at this lower frequency is also advantageous from the view that the greater the frequency the more expensive the microwave power source becomes. The known tunable cavity has a less than optimum shape because the lamp is substantially enclosed by the resonant cavity housing, thereby impeding the transmission of light.

SUMMARY OF THE INVENTION

It is an object of the invention to provide an improved electrodeless light source of the type excited by high frequency power.

It is another object to provide a light source having a termination fixture for holding the lamp in which the fixture design is such as to match the complex impedance of the lamp during excitation to the output impedance of the power source.

It is a further object to provide a fixture capable of matching the lamp impedance having a reactive impedance part which can be greater than the real impedance part without the need for tuning devices which are external to the fixture.

It is an additional object to provide a fixture design which can match the lamp complex impedance to the source output impedance by multiple sections of different values of characteristic impedance.

According to the present invention, a light source includes a high frequency power source, an electrodeless lamp containing a volatile fill material and a termination fixture which is coupled to the source and which couples power to the lamp. The fixture has an inner conductor and a outer conductor disposed around the inner conductor. The fixture has at least two impedance matching sections. The lengths and values of characteristic impedance of these sections are selected to match the complex impedance of the lamp to the output impedance of the source.

Preferably, where the lamp reactive impedance part is greater than the real impedance part, the first section is adjacent to the lamp, and the conductors have dimensions such as to transform the reactive impedance part of the lamp impedance to a low value at the input to the first section. In the second section, the conductors have dimensions effective to match the input impedance of the first section to the output impedance of the source. By dividing the fixture into two sections, the fixture dimensions are compatible with desirable features of the fixture other than for impedance matching, while at the same time an impedance match is provided where the lamp impedance has a large reactive impedance part. More importantly, a multiple section fixture can provide impedance matching for values of lamp impedance which can not be impedance matched with a single section of a uniform characteristic impedance.

DESCRIPTION OF PREFERRED EMBODIMENTS

Figure 1:
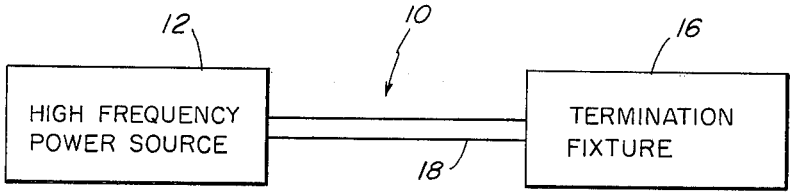
FIG. 1 is a block diagram illustrating major components of the light source according to the present invention.
Figure 2:
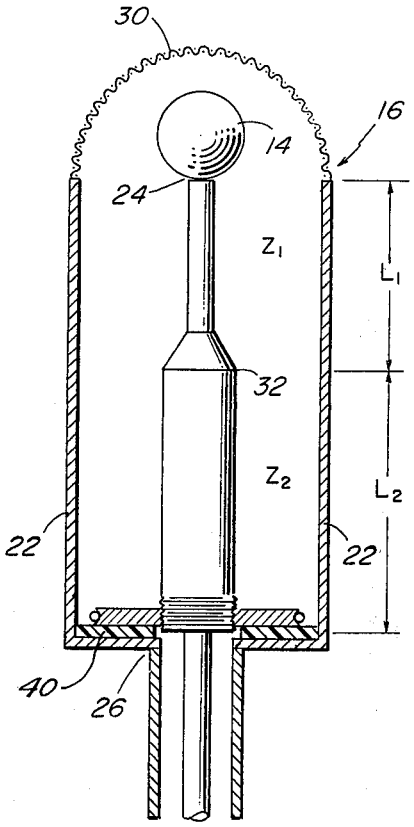
FIG. 2 is a partial sectional view of the termination fixture according to the present invention wherein the inner conduction has two sections of different dimensions in cross section.
Figure 3:
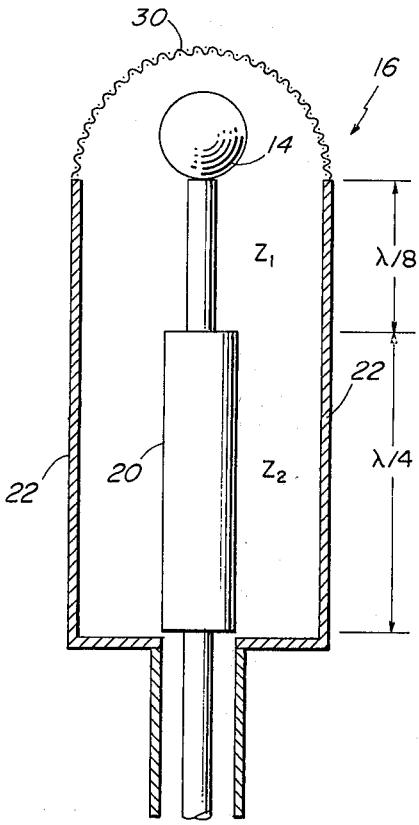
FIG. 3 is a preferred embodiment of a termination fixture in which the sections have lengths of $\lambda/8$ and $\lambda/4$.

In an exemplary embodiment of the present invention, as shown in FIG. 1, 2 and 3, a light source, indicated by the reference numeral 10, includes a source 12 of power at a high frequency, an electrodeless lamp 14 and a termination fixture 16 coupled to the source, such as by a transmission cable 18. As used herein, the phrase "high frequency" is intended to include frequencies in the range generally from 100 MHz to 300 GHz. Preferably, the frequency is in the ISM band (i.e., industrial, scientific and medical band) which ranges from 902 MHz to 928 MHz. In the preferred embodiments, the frequency used was 915 MHz. One of many commercially available power sources which may be used is an Airborne Instruments Laboratory Power Signal Source, type 125. The lamp 14 has an envelope made of a light transmitting substance, such as quartz. The envelope encloses a volatile fill material which produces a light emitting discharge upon excitation. The lamp envelope may have several configurations, such as being spherical in shape, as shown in FIG. 2 and 3, or being cylindrical in shape. Several known fill materials may be used, such as effective amounts of mercury and argon to produce a high pressure discharge. One suitable lamp is a spherical quartz envelope (15 mm ID) and a fill material having 9.1 mg mercury and 10 torr of argon. The lamp and coupling scheme 14 is of the type which has a complex impedance while operating. This impedance is designated $Z_L$ and is equal to $R \pm j\,X$, where $R$ is the arc resistance and $\pm j\,X$ is the reactive part of the impedance of the lamp. Most often, the reactive components or imaginary part is negative (capacitive) and generally $X$ is greater than R. One main feature of the present invention is matching the output impedance of the source to the lamp impedance when the lamp's reactive impedance is quite high and/or when the real impedance part is less than the output impedance of the source.

In practicing the invention, the complex impedance of the lamp in a fully operational or excited state must first be determined. This is accomplished by several known measuring techniques, such as by noting position and magnitude of voltage standing waves along a power coupling line of known characteristic impedance or by using a network analyzer, such as the Hewlett Packard HP84105 System.

The termination fixture 16, as shown in FIGS. 2 and 3, has inner conductor 20 and an outer conductor 22 disposed around the inner conductor 20. These conductors have a first end, represented at 24, which is in field coupling relation to the lamp and a second end 26 which is coupled to the source 12. The outer conductor may have a screen 30 disposed over the first end 24.

In accordance with the present invention, the conductors 20 and 22 have a first section, designated $L_1$, which extends from the first end 24 to a junction 32. In the first section $L_1$, the conductors 20 and 22 have dimensions in cross section and length which are selected to provide an input impedance, as viewed toward the lamp from the junction 32 which has a reactive impedance part which is substantially lower than the reactive impedance part of the lamp 14 while operating. Further, the fixture 16 has a second section $L_2$ extending from the second end 26 to the junction 32. In this section $L_2$, the conductors have dimensions in length and cross section which are selected to match the junction input impedance to the output impedance of the source 12.

The above-mentioned requirements are carried out as follows: First the general equation for a real input impedance ($Z_1$) at junction 32 for a given lamp impedance is as follows:

$$Z_1 = Zc_1 \frac{(R + jX + Zc_1 \cdot \tan \beta l_1)}{Zc_1 + (R + jX) \tan \beta L_1} \qquad (1)$$

$$= R_1 + jX_1$$

Where

R = the arc resistance of the lamp during excitation

X = the reactive impedance of the lamp during operation held at the end of the inner conductor $\beta = 2\pi/\lambda$ $l_1$ = the length of the section $L_1$ $\lambda$ = the wavelength for the high frequency power which is applied $Zc_1$ = the characteristic impedance for the first section For a given $R$ and $X$ a length and characteristic impedance is chosen which reduces the reactive impedance ($X_1$) as given by (1) to a value substantially lower than $X$. Then for this value of $Z_1$, a length ($l_2$) and a characteristic impedance $Zc_2$ for the second section $L_2$ is determined by the following equation:

$$Zc_2 = \left( Z_s R_1 + \frac{Z_s X_1^2}{R_1 - Z_s} \right)^{1/2} \qquad (2)$$

$$l_2 = \frac{\lambda}{2\pi} \tan^{-1} \frac{Zc_2 (Z_s - R_1)}{Z_s X_1} \qquad (3)$$

Where $Z_s$ = the impedance of the source $Zc_2$ = the characteristic impedance of the second section $l_2$ = the length of the section $L_2$ The characteristic impedance is defined in terms of the dimensions of the section in terms of its cross section. In the preferred embodiments, the conductors are circular in cross section and disposed concentrically with respect to each other. For such a case, $Zc_1$ or $Zc_2$ is determined by the following expression.

$$\frac{138}{(\epsilon_r/\mu_r)^{1/2}} \log \frac{b}{a}$$

Where $\epsilon_r$ = dielectric constant of the medium between the conductors $\mu_r$ = permeability of the medium between the conductors $b$ = inner diameter of the outer conductor $a$ = diameter of the inner conductor Thus, the characteristic impedance $Zc$ is a function of the ratio of conductor diameters. In the preferred embodiments, the proper ratio is obtained by keeping ($b$) constant and selecting an ($a$) which provides the proper value of $Zc$. This gives the fixture a uniform external appearance. However, it is to be understood that the proper ratio could be obtained by varying ($b$) over the sections $L_1$ and $L_2$ and either maintaining a uniform external appearance by varying the outer conductor thickness or obtaining a non-uniform external appearance by maintaining a constant outer conductor thickness.

Referring again to FIG. 2, the junction 32 is preferably tapered to provide a smooth transition between the smaller and larger diameter sections of the inner conductor. Also, the fixture 16 may include a capacitor 40 connected across the conductors at the second end 26.

This capacitor may be used for fine tuning the value of the reactive impedance of the fixture input impedance. Preferably, the first section $L_1$ has a length ranging from zero to a quarter wavelength.

Referring now to FIG. 3, an embodiment is illustrated in which the first section $L_1$ has a length of an eighth wavelength, and the second section has a length of a quarter wavelength. Making $L_1$ equal to $\lambda/8$ provides a low value for both $Z_1$ at junction 32 and Zc for the first section. For such a length $Z_1$ and $Zc_1$ in equations (1) and (2), respectively, reduce the following:

$$Z_1 = \frac{R(R^2 + X^2)^{1/2}}{(R^2 + X^2)^{1/2} - X} \quad \text{which has only a real magnitude}$$

$$Zc_1 = (R^2 + X^2)$$

The function of the quarter wave section L2 is then to transform the real impedance $Z_1$ at the junction 32 to the output impedance of the source 12. To do this, the second section L2 must have a characteristic impedance $Zc_2$ of $(Z_1 Z_s)$ where $Z_s$ equals the output impedance of the source.

There are several advantages of the termination fixture illustrated in FIGS. 2 and 3. First of all, the fixture provides a good impedance match and good power transfer from the coupled power source, such as by way of the coaxial cable 18, to a high frequency discharge light source having a complex impedance. Also, the fixture provides complete matching within the fixture without the need for an external tuner. Lastly, the fixture reduces the power loss.

If desired, fine tuning elements of various types may be used to accomodate various lamp types and variations in mechanical dimensions. A starting device, such as a UV source, may be used to assist in starting the lamp.

The embodiment illustrated in FIG. 2 and 3 may be used with several types of lamp geometries and fill materials. For example, one suitable lamp has a cylindrical shaped quartz envelope having a length 15 mm., an outer diameter of 5 mm and with a wall thickness of 1 mm. The fill material may comprise mercury and argon with additives of either ScI and $NaI_3$ or $NbOB_3$. Another lamp has a spherically shaped quartz envelope of 15 mm diameter. In this configuration, the fill material was mercury and argon with additives of either niobium oxybromide or tin iodide. With such lamps, good results are obtained, with less than 1% power reflected from the fixture in some cases. Both lamp configurations may be brought to a perfect match (<1% power reflected) by the use of fine tuning elements. It was noted that, although different conductor geometries were required for different lamp fills, within the same group, the same fixture worked extremely well for all the lamps. Also, the fixture matches to the lamp over a wide power range.

The embodiments of the present invention are intended to be merely exemplary and those skilled in the art shall be able to make numerous modifications and variations of them without departing from the spirit of the present invention. All such variations and modifications are intended to be included within the scope of the invention as described within the appended claims.

We claim:

1. A light source including, a. a source of power at a high frequency, b. an electrodeless lamp having an envelope made of a light transmitting substance, the envelope enclosing a volatile fill material which emits light upon breakdown and excitation, the lamp having a complex impedance in the operating condition; and c. a termination fixture coupled to the source, the fixture having an inner conductor and an outer conductor disposed around the inner conductor, the conductors, having a first end which couples power to the lamp and a second end which is coupled to the source, the fixture having at least first and second sections of different values of characteristic impedance, the values of characteristic impedance and the lengths of the sections being selected to match the complex impedance of the lamp in the operating condition to the output impedance of the source.

2. The light source according to claim 1, wherein the complex impedance of the lamp has a reactive impedance part which is greater than the real impedance part and wherein the first section extends from the first end to a junction in which the dimensions in cross section and in length of the conductors are selected to provide a junction input impedance which has a reactive impedance part which is a substantially lower than the reactive impedance part of the lamp in the operating condition and the second section extends from the second end to the junction, the second section having dimensions in length and cross section which are selected to match the junction input impedance to the output impedance of the source.

3. The light source according to claim 2, wherein the dimension in cross section of the outer conductor is constant throughout the first and second sections.

4. The light source according to claim 3, wherein the dimension in cross section of the inner conductor at the first section is smaller than the dimension in cross section of the inner conductor at the second section.

5. The light source according to claim 1, wherein the conductors are circular in cross section and are disposed concentrically with respect to each other.

6. The light source according to claim 1, wherein the dimension in length of the first section ranges from zero to one quarter wavelength.

7. The light source according to claim 5, wherein the dimension in length of the first section is one eighth wavelength thereby producing a junction input impedance having only a real impedance part.

8. The light source according to claim 7, wherein the dimension in length of the second section is equal to one quarter wavelength.

9. The light source according to claim 4, wherein the inner conductor is circular in cross section and wherein the inner conductor is tapered at the junction.

10. The light source according to claim 2 wherein the reactive impedance of the lamp is capacitive and further including a capacitor connected across the conductors at the second end for fine tuning the matching of the fixture input impedance to the output impedance of the source.

* * * * *

UNITED STATES PATENT OFFICE

CERTIFICATE OF CORRECTION

Patent No. 3,943,402 Dated March 9, 1976

Inventor(s) Paul O. Haugsjaa et al

It is certified that error appears in the above-identified patent and that said Letters Patent are hereby corrected as shown below:

Column 1, line 32, delete "Fehsenfield" and insert --Fehsenfeld--;

Column 1, line 42, delete "effiecient" and insert --efficient--;

Column 1, line 53, delete "ecomonically" and insert --economically--;

Column 1, line 61, delete "comsumer" and insert --consumer--;

Column 4, line 3, in equation (1), delete "$L_1$" in the denominator of the equation and insert --$\ell_1$--;

Column 5, line 18, delete "$Zc_1 = (R^2 + X^2)$" and insert --$Zc_1 = (R^2 + X^2)^{\frac{1}{2}}$--;

Column 5, line 23, delete "$(Z_1 Z_s)$" and insert --$(Z_1 Z_s)^{\frac{1}{2}}$--;

Signed and Sealed this twenty-second Day of June 1976

[SEAL]

Attest:

RUTH C. MASON
Attesting Officer

C. MARSHALL DANN
Commissioner of Patents and Trademarks